United States Patent [19]

Ichikawa et al.

[11] Patent Number: 4,887,529

[45] Date of Patent: Dec. 19, 1989

[54] INTERCHANGEABLE DRUM UNIT INTERCHANGE SYSTEM

[76] Inventors: Haruo Ichikawa, 4-16-9, Higashi-Koiwa, Katsushika-ku, Tokyo; Ryoichi Kanno, 1-22-4, Maihara-nishi, Funabashi-shi, Chiba-ken; Masato Nakatsukasa, 14-40-415, Bamba 3-chome, Ohtsu-shi, Shiga-ken, all of Japan

[21] Appl. No.: 247,232

[22] Filed: Sep. 21, 1988

[30] Foreign Application Priority Data

Sep. 25, 1987 [JP] Japan ..... 62-239051

[51] Int. Cl.[4] ..... B41F 5/06

[52] U.S. Cl. ..... 101/181; 101/216

[58] Field of Search ..... 101/181, 219, 228, 182, 101/247, 152, 153, 154, 178, 155–157, 185, 350, 351

[56] References Cited

U.S. PATENT DOCUMENTS 2,012,245 8/1935 Meisel ..... 101/178

4,239,001 12/1980 Kataoka ..... 101/247

FOREIGN PATENT DOCUMENTS 2046664 11/1980 United Kingdom ..... 101/227

2119712 11/1983 United Kingdom ..... 101/247

*Primary Examiner*—J. Reed Fisher

*Attorney, Agent, or Firm*—Armstrong, Nikaido, Marmelstein, Kubovcik & Murray

[57] ABSTRACT

An interchangeable drum unit interchange system in an interchangeable drum type rotary printing machine installation proposed to achieve the objects of releasing workers form heavy labor and dangerous work and remarkably shortening the time required for interchange of interchangeable drum units. The system comprises rack truck rails laid in parallel to a printing line in which a plurality of printing machines each having an interchangeable drum unit interchangeably mounted thereon are installed as aligned in one row, a plurality of sets of interchange truck rails extended from the printing line towards the rack truck rails at right angles thereto, a plurality of interchange trucks disposed on the respective sets of interchange truck rails respectively in a reciprocatable manner, a rack truck provided in a movable manner along the rack truck rails with new interchangeable drum units to be interchanged loaded thereon, an interchangeable drum unit reloading means provided on the rack truck for mutually reloading a plurality of sets of new and old interchangeable drum units between the interchange trucks and the rack truck.

3 Claims, 2 Drawing Sheets

INTERCHANGEABLE DRUM UNIT INTERCHANGE SYSTEM

BACKGROUND OF THE INVENTION

1. Field of the Invention

The present invention relates to an interchangeable drum unit interchange system, which makes it possible to quickly and systematically interchange a plurality of interchangeable drum units in an interchangeable drum type rotary printing machine installation.

2. Description of the Prior Art

In an interchangeable drum type rotary printing machine installations, the time necessary for the work of interchanging a plurality of interchangeable drum units occupies a great part in a printing process.

The interchange operation of interchangeable drum units in the prior art has involved such working process that a skilled worker draws a used interchangeable drum unit out of a printing machine, carries it up to an interchangeable drum unit set table while loading on an interchange truck, places the used interchangeable drum unit on the set table, subsequently transfers a new interchangeable drum unit to be used in the next printing work from the interchangeable drum unit set table to the interchange truck to carry it up to the printing machine, and mounts the new interchangeable drum unit to the printing machine. In the case where such interchange work is carried out for a plirality of interchangeable drum units, the work would necessitate a lot of time and labor.

In general, with regard to a variety of the interchangeable drum units, there are known the single-drum interchange type in which only a plate drum for use in typographic printing, number printing, etc. is interchanged, two-drum interchange type in which a pair of plate drums and press drums in typographic printing or a pair of plate drums and blanket drums in offset or dry offset are interchanged, three-drum interchange type in which a set of plate drums blanket drums, and press drums in offset or dry offset are interchanged, and further four-drum interchange type in which a set of upper plate drums, upper blanket drums, lower blanket drums and lower plate drums are interchanged in offset or dry offset for simultaneously printing both upper and lower surfaces.

Among the above-described respective types of the interchangeable drum units, in the case of the three-drum interchange type or the four-drum interchange type, depending upon the sizes of the drums, the weight could become heavier than 1 ton, and require heavy labor and become dangerous work for a worker to draw out these drums onto a truck by hands and to carry them between the interchangeable drum unit set table and the printing machine.

Especially, in the case of the four-drum interchange type, the weight becomes about 2 tons and exceeds the range of manual work by a worker. In addition, it is obvious that the interchange time would be remarkably increased due to handling of heavy drum units.

SUMMARY OF THE INVENTION

The present invention has been worked out in view of the above-described circumstance in the prior art. One object of the invention is to provide an interchangeable drum unit interchange system in an interchangeable drum type rotary printing machine installation, which can release workers from heavy labor and dangerous work, and which can remarkably shorten the time required for interchange of interchangeable drum units.

In order to achieve the aforementioned object, according to a first aspect of the present invention, there is provided an interchangeable drum unit interchange system in an interchangeable drum type rotary printing machine installation, comprising a printing line in which a plurality of rotary printing machines respectively having interchangeable drum units mounted thereon in an interchangeable manner are installed as aligned in one row. Rack truck rails are laid in parallel to the printing line. A plurality of sets of interchange truck rails, respectively, extended from interchangeable drum unit delivery positions in the respective rotary printing machines towards the rack truck rails substantially at right angles thereto. A plurality of interchange trucks adapted to reciprocate on the interchange truck rails are provided for the purpose of transfer of the interchangeable drum units. A rack truck is provided in a movable manner on the rack truck rails while loading thereon new interchangeable drum units to be interchanged. An interchangeable drum unit reloading means is provided on the rack truck for reloading a plurality of sets of new and used interchangable drum units between the interchange trucks and the rack truck.

In addition, according to a second aspect of the present invention, there is provided an interchangeable drum unit interchange system, characterized in that the interchangeable drum unit reloading means in the foregoing first aspect of the invention includes a self-traveling device for approximately moving the rack truck on the rack truck rails according to an interchange procedure for the interchangeable drum units. A plurality of stands are erected on the rack truck, at an interval equal to one-half of the interval between adjacent ones of the respective rotary printing machines, for placing the new and used interchangeable drum units thereon. A plurality of sets of on-truck rails are laid on the rack truck between the respective stands so as to correspond to the respective interchange truck rails and become extension rails thereof.

According to a third aspect of the present invention, there is provided an interchangeable drum unit interchange system, characterized in that the number of the stands in the second aspect of the invention is equal to twice the number of the rotary printing machines installed in the printing line plus one.

According to a fourth aspect of the present invention, there is provided an interchangeable drum unit interchange system, characterized in that each one of the interchange trucks in the first aspect of the invention includes a self-traveling device, a vertically movable loading table for loading the interchangeable drum unit thereon, and a holding device on the loading table for fixing the loaded interchangeble drum unit onto the loading table while traveling of the interchange truck.

The above and many other advantages, features and additional objects of the present invention will become manifest to those versed in the art upon making reference to the following detailed description and accompanying drawings in which one preferred structural embodiment incorporating the principles of the present invention is shown by way of illustrative example.

DETAILED DESCRIPTION OF THE PREFERRED EMBODIMENT

Now, one preferred embodiment of the present invention will be described with reference to the accompanying drawings.

Figure 1:
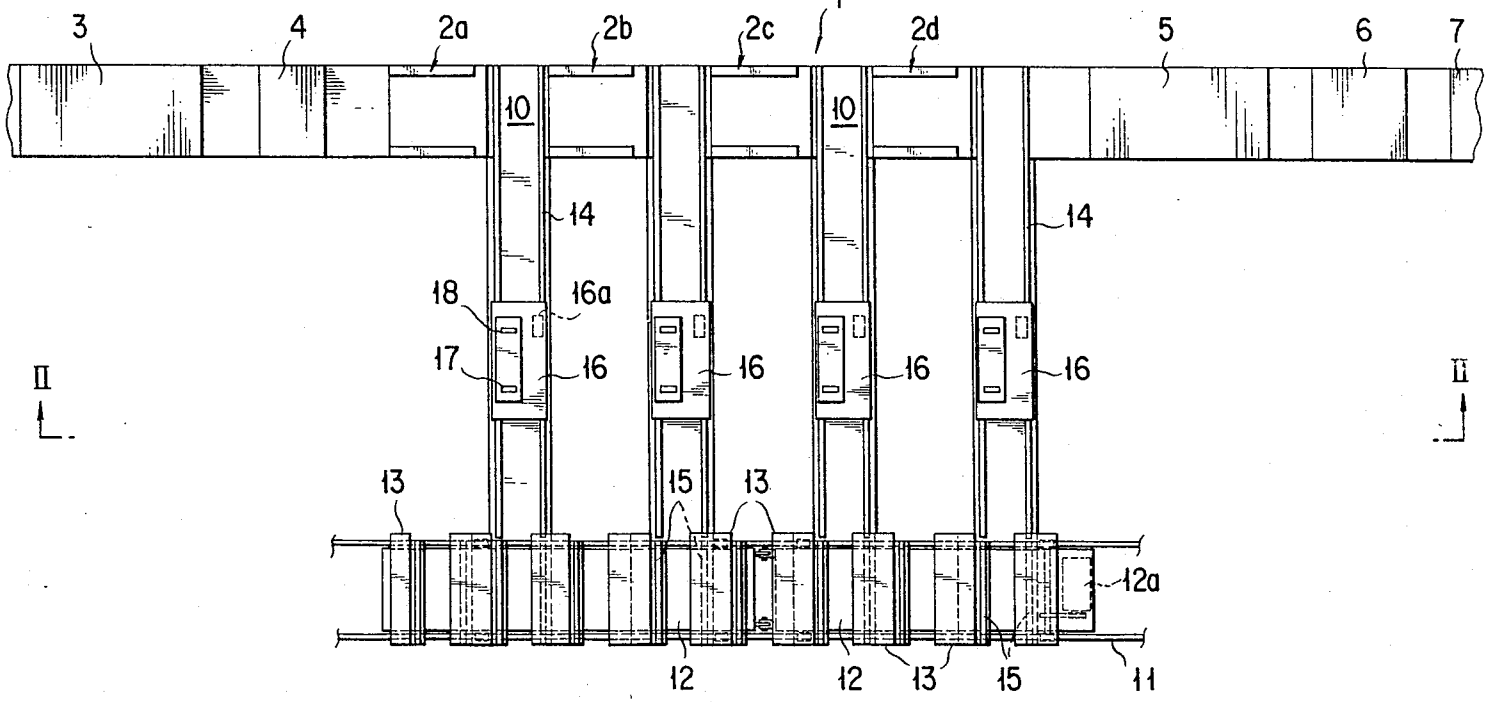
FIG. 1 is a schematic plan view showing one preferred embodiment of the present invention.
Figure 2:
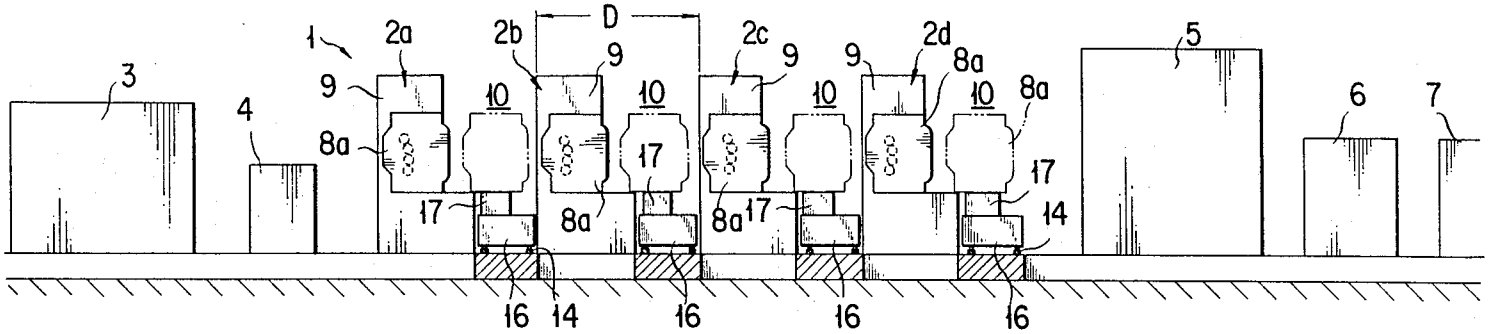
FIG. 2 is a schematic longitudinal cross-section view taken along line II—II in FIG. 1 as viewed in the direction of arrows.
Figure 3:
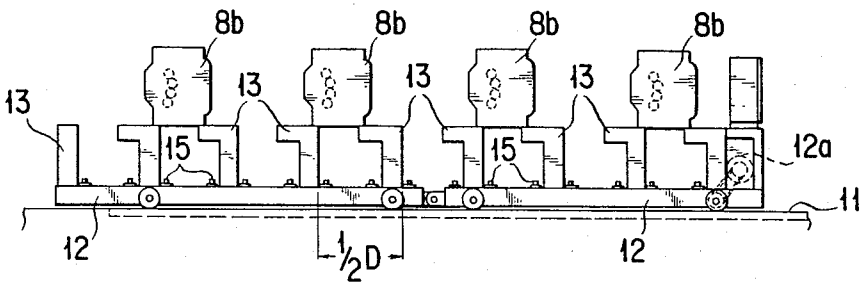
FIG. 3 is a schematic front view showing a rack truck section.

In FIGS. 1 to 3, reference numeral 1 designates a printing line including four rotary printing machines 2*a*, 2*b*, 2*c* and 2*d*, and numerals 3 and 4 designate splicer (auto-paster) and a constant-tensioning device, respectively, positioned on the upstream side of the printing line 1. In addition, reference numerals 5, 6 and 7 designate a drier, a cooling machine and a folding machine, respectively, disposed sequentially on the downstream side of the printing line 1. Each of the above-mentioned rotary printing machines 2*a*–2*d* is provided with an interchangeable drum unit 8*a* of four-drum interchange type. Each interchangeable drum unit 8*a* is constracted in a cassette form, and it is detachable towards the downstream side of the printing line 1 with respect to a frame 9 of the corresponding rotary printing machine. Between the adjacent ones of the rotary printing machines 2*a*–2*d* are provided interchangeable drum unit delivery positions 10 having an enough space for placing the interchangeable drum unit 8*a*.

Reference numeral 11 designates rack truck rails laid on a floor in parallel to the printing line 1. A rack truck 12 equipped with a self-propelling device 12*a* is placed on rack truck rails 11. On the rack truck 12 are erected a plurality of stands 13, for instance, nine stands 13, equal to twice the number of the rotary printing machines 2*a*–2*d* plus one, aligned in the direction of traveling. These respective stands 13 are provided at an interval equal to one-half of the interval between adjacent ones of the rotary printing machines 2*a*–2*d*. A new interchangeable drum unit 8*b* to be interchanged is adapted to be placed on both the adjacent stands so as to bridge them.

On the floor surface of the interchangeable drum unit delivery position 10 within each of the abovementioned rotary printing machines 2*a*–2*d* are laid interchange truck rails 14 at right angles to the printing line 1 towards the rack truck rails 11. In addition, on the rack truck 12, and between adjacent ones of the respective stands 13, are disposed on-truck rails 15 corresponding to the above-described interchange truck rails 14 directed in the direction perpendicular to the rack truck rails 11.

Reference numeral 16 designates interchange trucks placed on the above-mentioned respective interchange truck rails 14, and these interchange trucks 16 are adapted to travel between the interchangeable drum unit delivery positions 10 within the respective rotary printing machines 2*a*–2*d* and the stands 13 on the rack truck 12, under the condition where the on-truck rails 15 on the rack truck 12 have been aligned with the above-described interchange truck rails 14 by adjusting the position of the rack truck 12.

The above-described interchange truck 16 is equipped with a self-propelling device 16a, such as a motor, and at the upper portion of this truck 16 is provided a loading table 17 in a vertically movable manner, which loading table is adapted to be loaded with the interchangeable drum unit 8*a* placed on the stands 13 so as to bridge them, by raising the drum unit 8*a* through a predetermined process. Furthermore, this interchange truck 16 is provided with a fixing device 18 for fixing the interchangeable drum unit 8*b* loaded on the loading table 17.

Now the operation of the interchangeable drum unit interchange system having the above-mentioned construction will be explained with respect to the case where two kinds of interchangeable drum units 8*a* and 8*b* are interchanged in the respective ones of the rotary printing machines 2*a*–2*d*.

Assuming that used first interchangeable drum units 8*a* are mounted to the respective ones of the rotary printing machines 2*a*–2*d*, then new second interchangeable drum units 8*b* corresponding to these used drum units 8*a* are preliminarily placed at every other loading positions on the stands 13 of the rack truck 12.

In order to interchange the respective first interchangeable drum units 8*a* and the respective second interchangeable drum units 8*b* under the above-mentioned condition, the interchange trucks 16 first enter the interchangeable drum unit delivery positions 10, and the respective first interchangeable drum unit 8*a* set in the corresponding rotary printing machines 2*a*–2*d* are reloaded onto the loading tables 17 of the interchange trucks 16. At this time, the respective interchangeable drum units 8*a* are pushed by push-pull devices (not shown) provided in the respective rotary printing machines 2*a*–2*d* and reloaded onto the loading tables 17 of the interchange trucks 16.

Subsequently, the loading table 17 is raised, the interchangeable drum unit 8*a* is fixed by means of the fixing device 18, and the interchange trucks 16 then travel along the interchange truck rails 14 towards the rack truck 12.

On the other hand, meanwhile the self-propelled rack truck 12 on rail 11 to set the respective on-truck rails 15 between the respective stands 13 which are empty at this time on the rack truck 12, at the positions corresponding to the above-mentioned interchange truck rails 14.

The respective interchange trucks 16, having the above-mentioned respective first interchangeable drum units 8*a* loaded thereon stop, and then advance along the respective on-truck rails 15 and enter the spaces between the empty stands 13. The loading tables 17 are lowered and the fixing devices 18 are released. The respective first interchangeable drum units 8*a* are, thus loaded on the respective stands 13 so as to bridge the adjacent ones of them.

Next, the above-described repective interchange trucks 16 are self-propelled to standby positions on the interchange truck rails 14 and set to stand by. Under this condition, the self-propelled rack truck 12 is moved over a predetermined number of pitches to be set at such position that the respective on-truck rails 15 between the respective adjacent stands 13 on which respective second interchangeable drum units 8*b* intended to be interchanged are loaded so as to bridge them, are aligned with the corresponding interchange truck rails 14.

Under this condition, the respective interchange trucks 16 are advanced and enter in the spaces between the respective stands 13 along the respective ontruck rails 15. The loading tables 17 are then raised to load the respective second interchangeable drum units 8*b* thereon, and the loaded interchangeable drum units 8*b* are fixed by the fixing devices 18. Subsequently, the respective interchange trucks 16 are made to travel along the interchagne truck rails 14 and enter in the interchangeable drum unit delivery positions 10 within the respective rotary printing machines 2a–2d. The the loading tables 17 are then lowered, and simultaneously the fixing devices 18 are released. Next, the respective second interchangeable drum units 8b on the above-described loading tables 17 are pulled into the respective rotary printing machines 2a–2d by means of the push-pull devices. The respective interchange trucks 16 are made to stand by until the next interchangeable drum unit interchange cycle, at the standby positions on the respective interchange truck rails 14 for the respective interchange trucks 16.

While the above-described embodiment is the case where the variety of the interchangeable drum units are two kinds, the situation is the same even if the variety of the interchagneable drum units is increased to 3 or 4 kinds. In such modified cases, the number of the stands 13 on the rack truck 12 is increased correspondingly.

The above description concerns general explanation of operations, and now description will be made on a first automatic itnerchange mode in which interchange of interchangeable drum units is effected automatically, and a second automatic interchange mode in which interchangeable drum units are drawn out from the rack truck 12 for the purpose of carrying out plate interchange or interchange work for a blanket in preparation for the next work.

(I) First Automatic Interchange Mode:

(1) The rack truck 12 and the interchange trucks 16 are standing by.

(2) In response to a start signal of the first automatic interchange mode, the self-propelled interchange trucks 16 start and enter in the interchangeable drum unit delivery positions within the respective rotary printing machines 2a–2d, and are prepared to receive used interchangeable drum units 8a.

(3) The used interchangeable drum units 8a are transferred onto the interchange trucks 16 by means of push-pull devices of the rotary printing machines 2a–2d, respectively.

(4) The self-propelled interchange trucks 16, having received the used interchangeable drum unis 8a, start from the interchangeable drum unit delivery positions 10, with the loading tables 17 kept raised, after the interchangeable drum units 8a have been fixed on the loading tables 17 by means of the fixing devices 18.

(5) Meanwhile, the self-propelled rack truck 12 moves to a position corresponding to the set position for the used interchangeable drum units which are to be carried in by the interchange trucks 16.

(6) The interchange trucks 16 enter onto the rack truck 12, and after they have stopped at predetermined positions, the loading tables 17 are lowered to reload the used interchangeable drum units 8a on the rack truck 12, and thereafter the interchange trucks 16 come out of the rack truck 12 and stop at standby positions on the interchange truck rails 14.

(7) The rack truck 12 is moved to a position corresponding to new interchangeable drum units 8b to be used for next printing.

(8) The interchange trucks 16 enter onto the rack track 12, and after the new interchangeable drum units 8b have been loaded thereon and fixed in position, the interchange truck 16, with the loading tables 17 kept raised, leave the rack truck 12.

(9) The interchange trucks 16 enter in the spaces between the rotary printing machine 2a–2d and again stop at the interchange drum unit delivery positions 10. Then the loading tables 17 are lowered, and preparation for delivery such as release of fixing is effected.

(10) The new interchange drum units 8b are pulled into the rotary printing machines 2a–2d by means of the push-pull devices.

(11) The interchange trucks 16 start and standby at the standby positions. Thereafter, the interchange trucks 16 are made to enter onto the rack truck 12, and now the work has been completed.

(II) Second Automatic Interchange Mode:

(1) The interchange trucks 16 are standing by on the rack truck 12.

(2) In response to a start signal of the second automatic interchange mode, the interchange trucks 16 start.

(3) The interchange trucks 16 stop at the standby positions on the interchange truck rails 14.

(4) The rack truck 12 moves to a position corresponding to the loading position of the interchangeable drum units for performing plate interchange.

(5) The interchange trucks 16 enter onto the rack truck 12, and the above-mentioned interchangeable drum units are loaded thereon and fixed in position.

(6) After the loading tables have been raised, the interchange trucks 16 start with the interchangeable drum units kept loaded thereon, and stop at the standby positions (the positions shown in FIG. 1).

(7) Workers perform interchange work of plate or blanket drums on the interchange trucks 16, and a work finish signal is issued.

(8) The interchange trucks 16 enter onto the rack truck 12. After truck 16 have stopped at predetermined positions, the loading tables 17 are lowered, the interchangeable drum units are again reloaded onto the rack truck 12, and now the second automatic interchange mode has been finished.

We claim:

1. An interchangeable drum unit interchange system in an interchangeable drum type rotary printing machine installation, comprising a printing line in which a plurality of rotary printing machines, respectively having interchangeable drum units mounted thereon in an interchangeable manner, are aligned in a one row printing line, a pair of rack truck rails are laid in parallel to said printing line, a self-propelled rack truck on said rack truck rails, a plurality of sets of interchange trucks rails extending from interchangeable drum unit positions intermediate said rotary printing machines on said printing line towards said rack truck rails and substantially at right angles to said printing line and said truck rails, a self-propelled interchange truck on each set of said interchange truck rails for reciprocation on said interchange truck rails for transferring said interchangeable drum units, and interchangeable drum unit reloading means provided on said rack truck for unloading used drum units and reloading new interchangeable drum units between said printing machines, said interchange trucks and said rack truck, said interchangeable drum unit reloading means includes means for moving said rack truck on said rack truck rails to an interchange position for interchanging said drum units, a plurality of stands erected on said rack trucks at an interval equal to one-half of the interval between adjacent ones of said respective rotary printing machines for selectively placing new and used interchangeable drum units thereon, and a plurality of sets of on-truck rails laid on said rack truck between said respective stands so as to correspond to said respective interchange truck rails and for alignment therewith.

2. An interchangeable drum unit interchange system as claimed in claim 1, characterized in that the number of said stands is equal to twice the number of the rotary printing machines installed in said printing line plus one.

3. An interchangeable drum unit interchange system as claimed in claim 1, characterized in that each one of said interchange trucks includes, a loading table for loading said interchangeable drum unit thereon in a vertically movable manner, and a fixing device for fixing said loaded interchangeable drum unit onto said loading table for traveling of said interchange truck.

* * * * *

UNITED STATES PATENT AND TRADEMARK OFFICE

CERTIFICATE OF CORRECTION

PATENT NO. : 4,887,529

DATED : December 19, 1989

INVENTOR(S) : ICHIKAWA et al

It is certified that error appears in the above-identified patent and that said Letters Patent is hereby corrected as shown below:

On the cover page, after Item [76], add the following:

--[73] Assignees: Miyakoshi Printing Machinery Co., Ltd., Tokyo; Toyo Umpanki Co., Ltd.,Osaka, both of Japan--.

Signed and Sealed this

Nineteenth Day of March, 1991

*Attest:*

HARRY F. MANBECK, JR.

*Attesting Officer*

*Commissioner of Patents and Trademarks*